US006871359B2

(12) United States Patent
Han

(10) Patent No.: US 6,871,359 B2
(45) Date of Patent: Mar. 29, 2005

(54) INNER CLOTH FOR GLOVE AND GLOVE FABRICATED USING THE SAME

(76) Inventor: Dong Sik Han, 104-403, Miju Apt., Deungchon 3-dong, Gangseo-gu, 157-033 Seoul (KR)

( * ) Notice: Subject to any disclaimer, the term of this patent is extended or adjusted under 35 U.S.C. 154(b) by 202 days.

(21) Appl. No.: 10/234,556

(22) Filed: Sep. 4, 2002

(65) Prior Publication Data

US 2003/0167555 A1 Sep. 11, 2003

(30) Foreign Application Priority Data

Mar. 9, 2002 (KR) ..... P2002-12662

(51) Int. Cl.[7] ..... A41D 19/00
(52) U.S. Cl. ..... 2/161.6; 2/169
(58) Field of Search ..... 2/16.2, 163, 169, 2/161.6, 164

(56) References Cited

U.S. PATENT DOCUMENTS 4,918,756 A * 4/1990 Grilliot et al. ..... 2/164
5,123,119 A * 6/1992 Dube ..... 2/168
5,349,705 A * 9/1994 Ragan ..... 2/161.6
5,822,795 A * 10/1998 Gold ..... 2/159
6,594,830 B2 * 7/2003 Geng ..... 2/164

* cited by examiner

*Primary Examiner*—Katherine M. Moran
(74) *Attorney, Agent, or Firm*—Thomas R. FitzGerald, Esq.

(57) ABSTRACT

The present invention relates to an inner cloth for a glove which is inserted between a lining material contacting with a user's skin and an outer skin exposed to the outside and includes a certain connection member for thereby being fixed together with a lining material and an outer skin based on a sewing operation, so that it is possible to implement good moisture penetration, anti-cold, and waterproof functions. The inner cloth for a glove includes a pair of hand-shaped panel members which each include a certain size or area and an edge portion connected at a certain width, and a connection member which is arranged at a certain position of the pair of the panel members and is integrally formed when the panel members are connected, and is formed in a certain shape. The glove implements good moisture penetration, anti-cold and waterproof functions using the inner cloth of the present invention.

10 Claims, 5 Drawing Sheets

INNER CLOTH FOR GLOVE AND GLOVE FABRICATED USING THE SAME

BACKGROUND OF THE INVENTION

1. Field of the Invention

The present invention relates to a glove which is worn during an exercise such as a ski, snowboard, bicycle, motorcycle, mountain climbing, etc. and a certain work, and in particular to an inner cloth for a glove which is inserted between a lining material directly contacting with a user's skin and an outer skin exposed to the outside and includes a certain connection member for thereby being fixed together with a lining material and an outer skin based on a sewing operation, so that it is possible to implement good moisture penetration, anti-cold, and waterproof functions.

2. Description of the Background Art

Generally, a glove used for an exercise such as a ski, snowboard, motorcycle, etc. must have an anti-cold and/or good moisture penetration and/or waterproof function. In order to implement the above functions, a coating operation is performed with respect to an outer cloth of the glove for thereby obtaining a desired good moisture penetration and waterproof function. Recently, an inner cloth like a functional source cloth is included in the interior of the glove, so that the glove has a good moisture penetration and waterproof function.

The above inner cloth used for the glove is formed of a source material of a smooth synthetic resin. Since the outer surface of the source material is sleek, the source material is not easily contacted, so that the source material separates the lining material and the outer skin. Therefore, in order to overcome the above problems, the inner cloth is inserted between the lining material and the outer skin, and then the lining material, outer skin and inner cloth are sewed together, so that the lining material and outer skin are connected with the inner cloth.

However, a certain hole may be formed in the inner cloth connected between the outer skin and the lining material by a needle during a sewing operation. Therefore, the glove including the inner cloth has a low waterproof function due to the sewing operation. In addition, it is difficult to fabricate the above glove.

According to the Korean Patent Laid-open No. 1996-0003624(Laid-open date: Feb. 23, 1996, Title: Waterproof for sports and a method for fabricating an inner glove having a waterproof function) and the Korean Utility Model No. 20-0171574(Issue date: Mar. 15, 2000, Title: Glove for ski), there are provided methods for connecting an inner cloth and an outer skin and/or a lining material by applying an adhesive on the outer skin and/or lining material.

However, in the method in which the adhesive is used, it is difficult to implement a process for applying an adhesive on the lining material or outer skin. The reliability of an adhesive force is low. Therefore, the method using the adhesive increases an error ratio for fabricating the glove, and the fabrication process of the glove is complicated.

SUMMARY OF THE INVENTION

Accordingly, it is an object of the present invention to provide an inner cloth which is inserted between a lining material contacting with a user's skin and an outer skin exposed to the outside and is fixed together with the lining material and the outer skin by a sewing operation for thereby implementing desired moisture penetration, anti-cold and waterproofing functions and to provide a glove fabricated using the inner cloth.

It is another object of the present invention to provide an inner cloth which is inserted between a lining material contacting with a user's skin and an outer skin exposed to the outside and includes a connection member for being fixed together with the lining material and the outer skin by a sewing operation for thereby implementing desired moisture penetration, anti-cold and waterproofing functions and to provide a glove fabricated using the inner cloth.

To achieve the above objects, there is provided an inner cloth for a glove which includes a pair of hand-shaped panel members which each include a certain size or area and an edge portion connected at a certain width, and a connection member which is arranged at a certain position of the pair of the panel members and is integrally formed when the panel members are connected, and is formed in a certain shape.

To achieve the above objects, there is provided a glove fabricated using the inner cloth which includes a lining material which directly contacts with a skin of hands, an outer skin which is exposed to an external environment, and an inner cloth which is inserted between the lining material and the outer skin and includes a certain connection member for thereby being connected with the lining material and the outer skin, respectively.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

Figure 1:
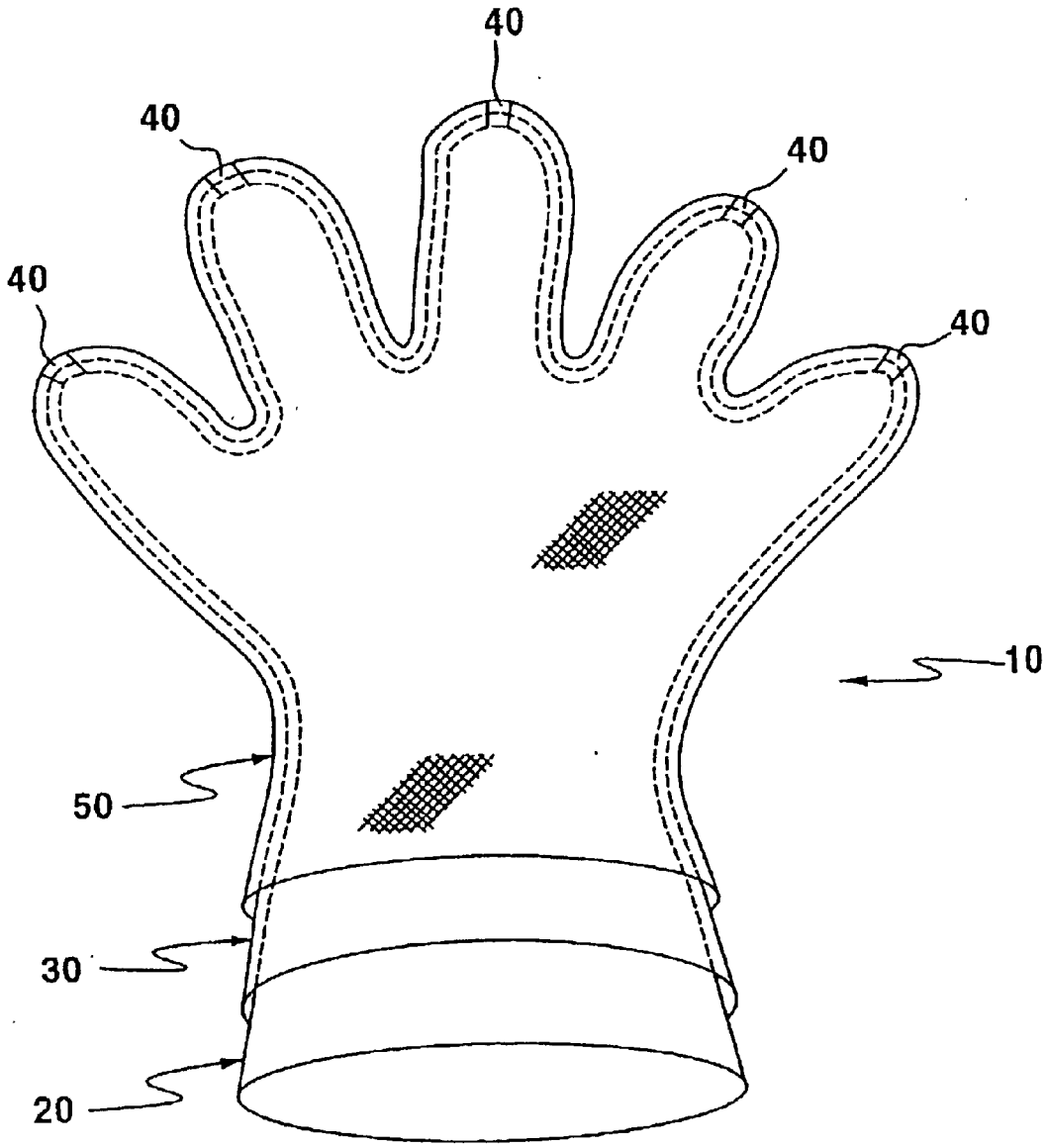
FIG. 1 is a perspective view illustrating a glove according to the present invention.

FIG. 1 is a perspective view illustrating a glove according to the present invention. The glove includes a lining material 20, an outer skin 50 which is exposed to an external environment, and an inner cloth 30 inserted between the lining material 20 and the outer skin 50. The inner cloth 30 is attached to an end of each finger and includes a connection member 40 connected to the lining material 20 and the outer skin 50.

The lining material 20 is directly contacted with the skins of a user's wrist and hand and is formed of a synthetic fiber fabric or cotton fabric or a certain material like a wool having a warm keeping function and moisture penetration function as well as a certain elastic force.

Since the outer skin 50 is exposed to an external environment, the outer skin 50 is formed of a certain durable material such as a fabric, coating cloth, artificial leather or natural leather.

Figure 2A:
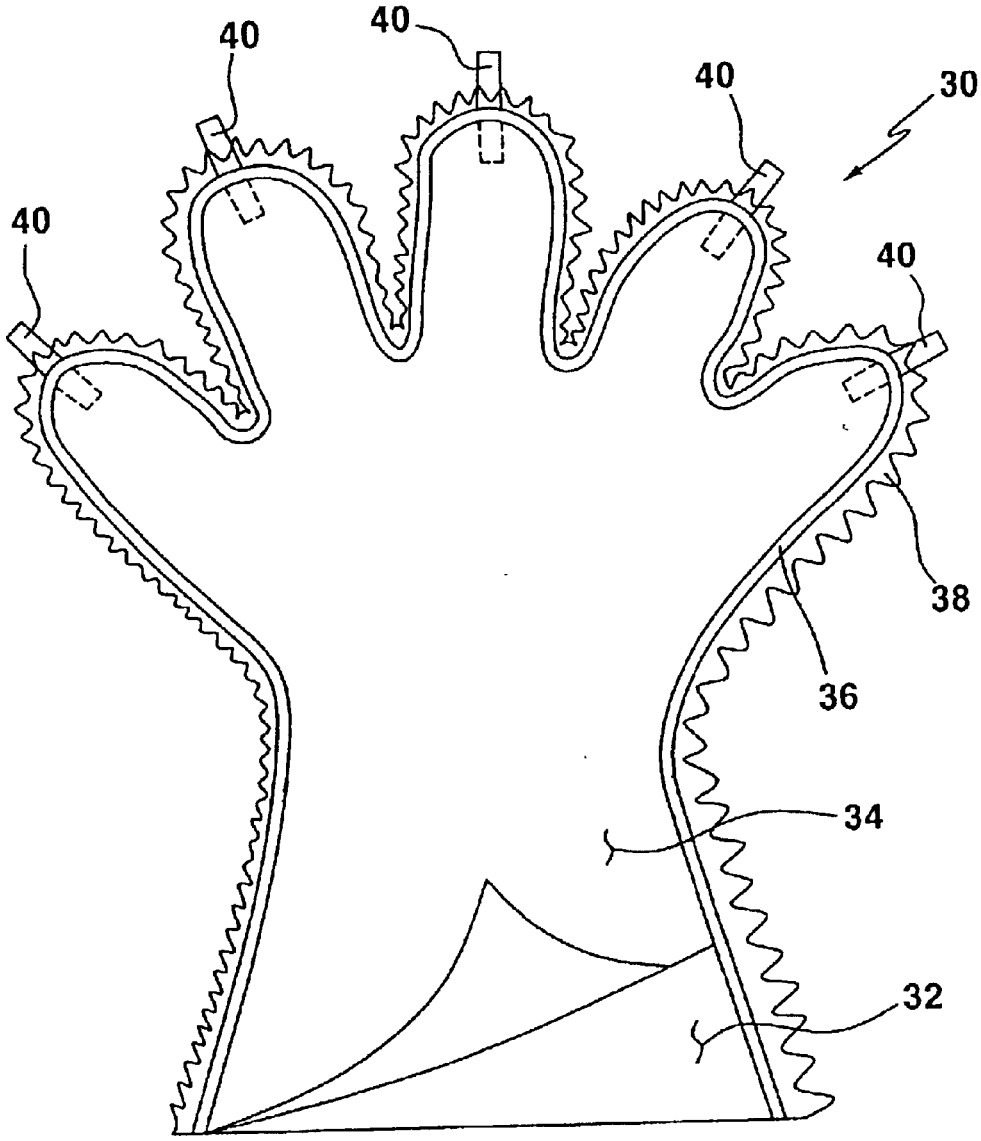
FIG. 2A is a cut-away view illustrating an inner cloth of a glove according to the present invention.

As shown in FIG. 2A, the inner cloth 30 surrounds the lining material 20 and is formed of panel members 32 and 34 corresponding to a palm or the back of a hand, a sealing portion 36 which is formed in a shape of a hand and is formed by sealing an edge portion of the panel member by a certain width, a peripheral portion 38 which is formed opposite to the panel member with respect to the sealing portion 36 or in an outer portion of the sealing portion, and a connection member 40 in which an inner portion 41(in the side of the panel member) and an outer portion 42(in the side of the peripheral portion) with respect to the sealing portion 36 in an end portion of each finger are alternately crossed, and a crossed portion 43 is connected with the sealing portion 36.

Figure 2B:
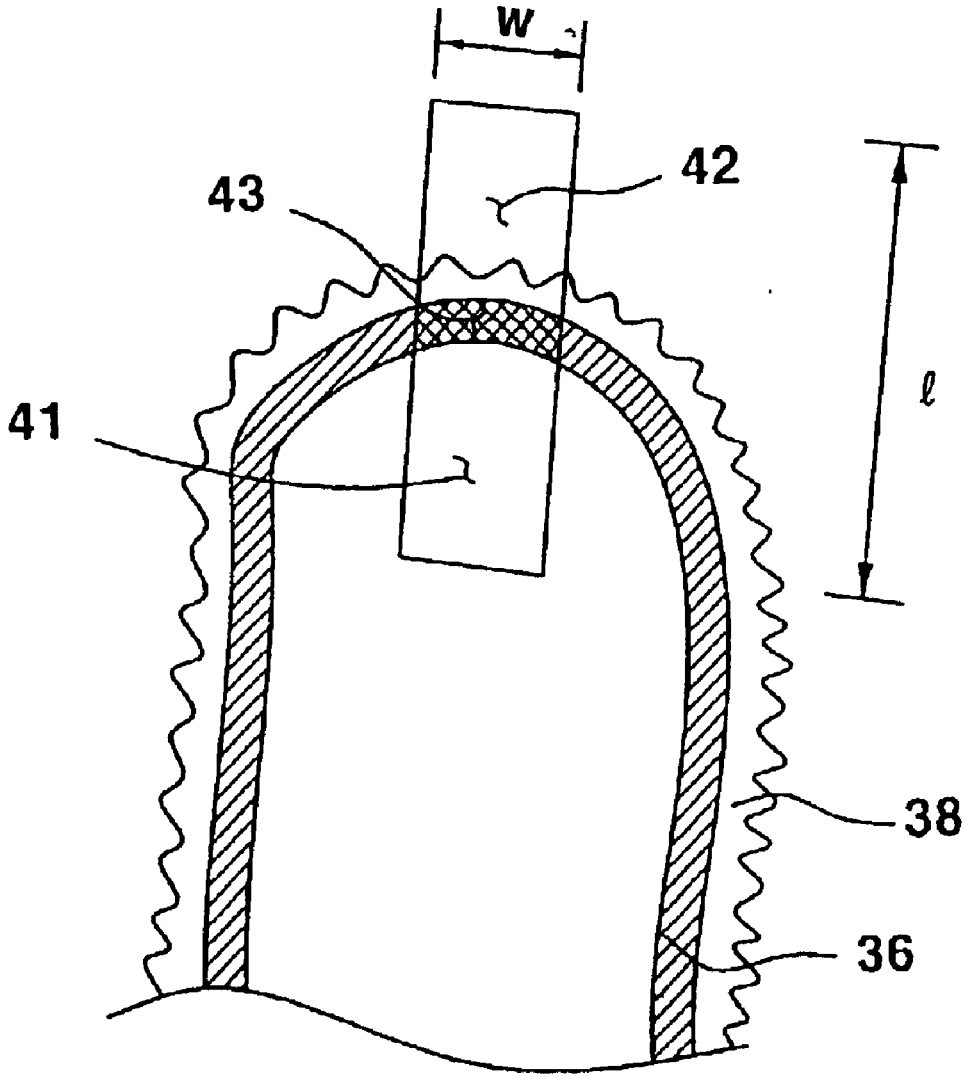
FIG. 2B is a view illustrating a connection member attached to an end of an inner cloth according to the present invention.

FIG. 2B is a view illustrating a connection member 40 which is attached to an end of the inner cloth 30 and is formed in a rectangular stripe shape having a previously determined length L and a previously determined width W. Here, the above length L and width W are determined at a certain size in order for the lining material and the outer skin to be connected by a sewing operation. Preferably, the sizes of the same are implemented when the intermediate portion of the length L is crossed with the sealing portion.

The fabrication method of the inner cloth having the above described constitution according to the present invention will be described.

First, a hand-shaped panel member having a certain size or area and a connection member having a certain size are prepared. The connection member is arranged in an end portion of each finger of the panel member in such a manner that the connection member is covered by a half of the length of the connection member.

Next, two panel members including the connection member are joined in their edge portions including the fingers using heat. A sealing portion is formed in each panel member using a certain apparatus like a high frequency generation apparatus or an electric heat apparatus.

Therefore, the inner cloth 30 and connection member 40 according to the present invention may be formed of a smooth synthetic resin(polyurethane, polyethylene, etc.) which is easily molten by heat or a membrane formed by providing a certain function to the synthetic resin, a cotton fabric like a cotton texture, waterproof fabric, synthetic fiber, mixed spinning chemical fiber and a specialty coated material. Here, the above function represents a moisture penetration function and a waterproof function, and a water absorption function and waterproof function which are capable of quickly absorbing sweat generated in hands and outputting to the outside. The membrane represents a material fabricated by coating a special natural protein or a material fabricated using a water absorption or denatured silicon and a Shape Memory Resin.

In the above embodiment of the present invention, the shape of the connection member is rectangular. However, the connection member may be formed in other shapes in such a manner that the connection member is crossed with respect to the sealing portion and then is engaged. In addition, in the above embodiment of the present invention, the connection member is implemented in one layer. In another embodiment of the present invention, the connection member may be implemented in multiple layers. The multiple-layer connection member is formed by overlapping the connection members of stripe shape by the length L in multiple layers.

In addition, in the above embodiment of the present invention, the connection member 40 is arranged in an end of each finger of the inner cloth 30 to match each other in one-to-one method. In another embodiment of the present invention, the connection member 40 may be arranged in another portion. Therefore, the number of the connection members may be over 5.

Figure 3:
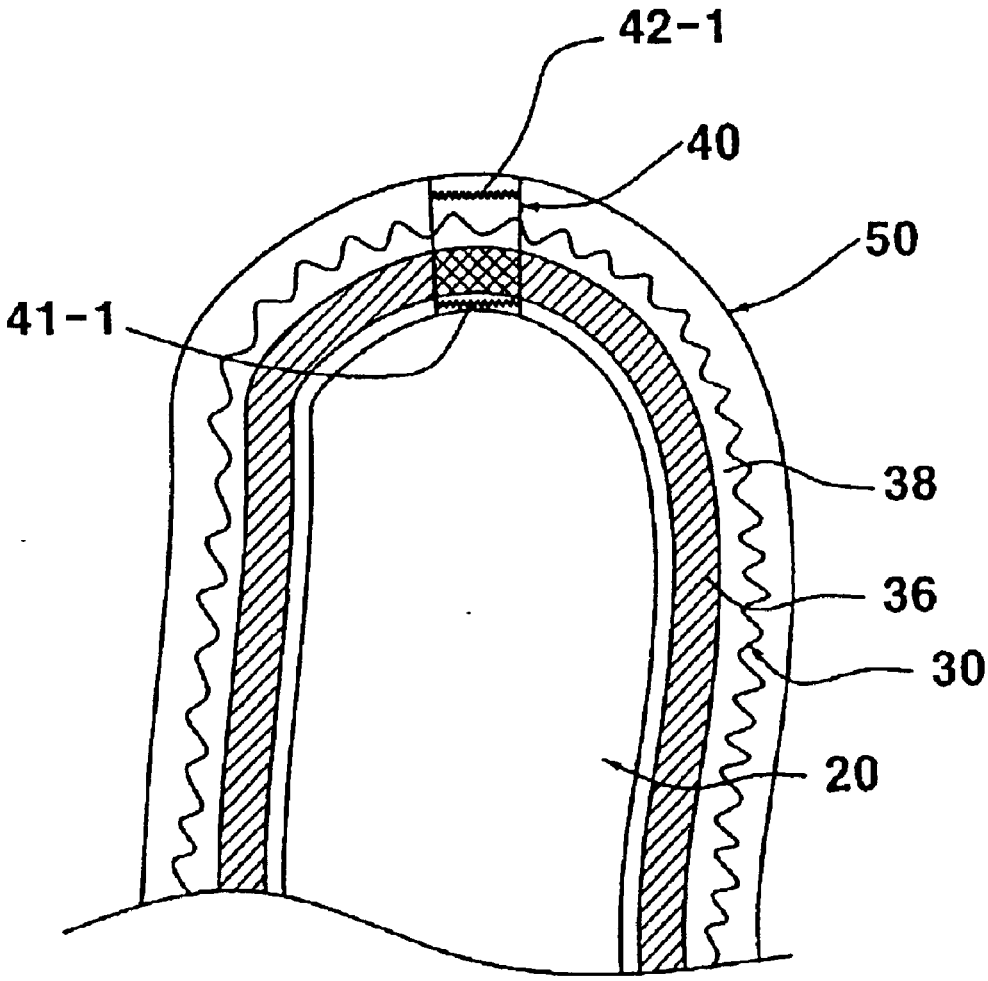
FIG. 3 is a view illustrating an end of a finger of a glove of FIG. 1.

As shown in FIG. 3, in the glove fabricated using the inner cloth having the above shape according to the present invention, the inner side 41 of the connection member is sewed together with the end of the lining material 20, and the lining material 20 of the inner cloth 30 is connected(inner sewed portion 41-1), and the outer portion 42 of the connection member 40 is sewed with the end portion of the outer skin 50. The inner cloth 30 and the outer skin 50 are connected(outer sewed portion 42-1). The above described construction will be described in more detail.

Figure 4:
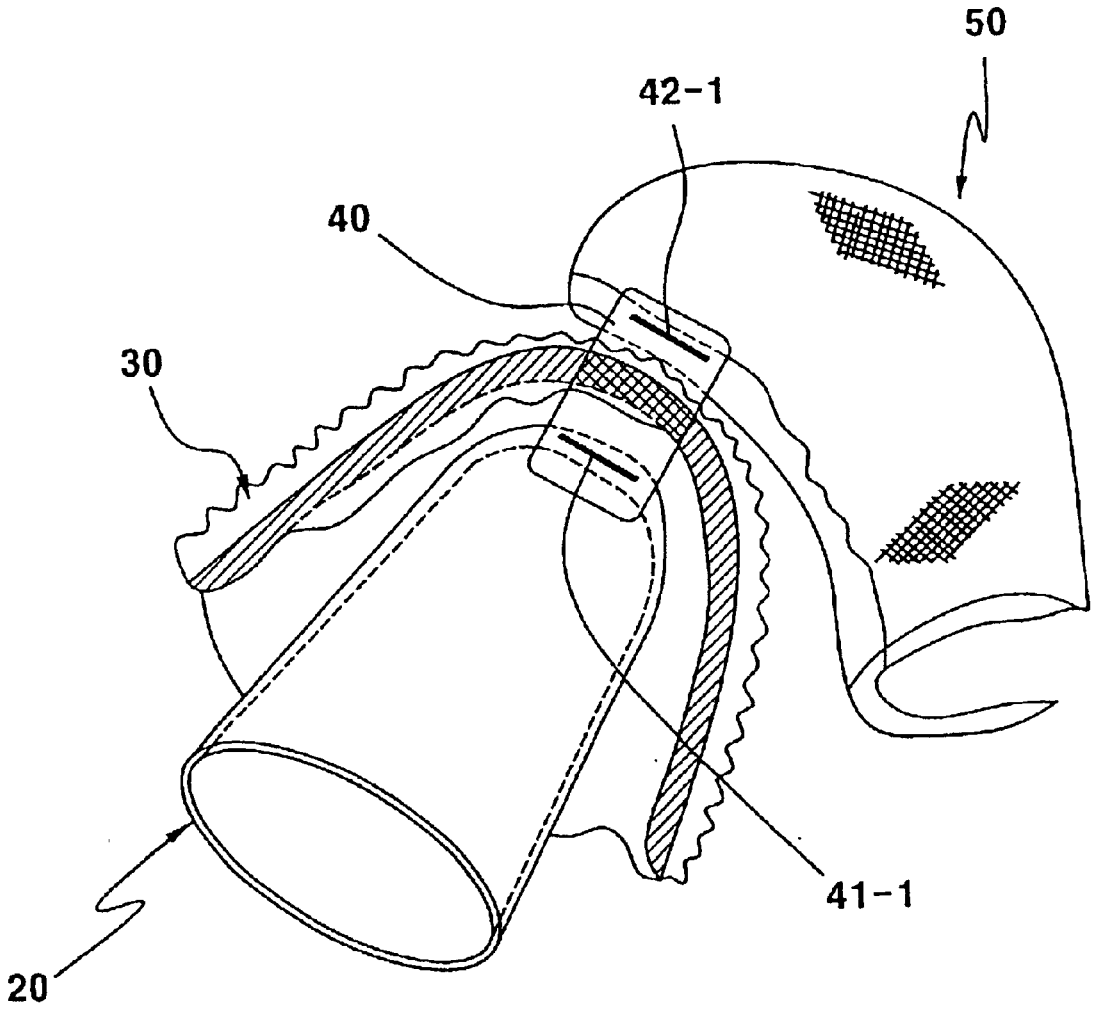
FIG. 4 is a cut-away view for describing a sewing stare of an outer skin and a lining material based on an inner cloth according to the present invention.

As shown in FIG. 4, the inside of the inner cloth is turned out, and the inner portion 41 of the connection member 40 attached to an end of the finger of the inner cloth 30 and the end portion of the inner cloth 20 are connected by sewing the same. At this time, the sewing portion represents an inner sewing portion 40-1. The above operation is repeatedly performed with respect to an end of each finger for thereby connecting the inner cloth and the end of each finger of the inner cloth.

Next, the inside of the inner cloth is turned out for thereby surrounding the lining material, and then the lining material is positioned in the inner cloth, so that the outer portion 42 of the inner cloth is exposed to the outside.

In order to connect the inner cloth and the outer skin, the inside of the outer skin is turned out, and the outer portion 42 attached to an end of each finger of the inner cloth and an end of the outer skin of the outer skin are sewed and connected. At this time, the sewing portion represents an outer sewing portion 42-1. The above operation is repeatedly performed with respect to an end of each finger, so that the inner cloth and the end of each finger of the outer skin are all connected.

Next, the inside of the outer skin is turned out for thereby surrounding the inner cloth, so that the fabrication of the glove is finished.

As described above, in the inner cloth for a glove according to the present invention, a separate connection member is integrally formed in a certain portion, namely, an end portion of each finger, so that the connection member is connected with the lining material and the outer skin for thereby preventing any damage when the glove is fabricated. Therefore, it is possible to maximize an inherent function of the glove.

In the glove according to the present invention, the inner cloths 30 inserted between the lining material 20 and the outer skin 50 are fixedly connected, and then the connection member attached to the inner cloth and the outer skin and the lining material are sewed, so that a needle hole is not formed in the inner cloth 30. Therefore, it is possible to implement a maximum waterproof and anti-cold function of the inner cloth 30.

In addition, in the method for fabricating the glove according to the present invention, since an adhesive or waterproof adhesive tape and glue are not used, the fabrication process is simple, and the error ratio is low, and it is possible to decrease the fabrication cost.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. An inner cloth for a glove, comprising:

a pair of hand-shaped panel members which each include a certain size or area and an edge portion connected at a certain width; and a sealing portion formed at the position which the edge portion of the panel members is joined by heat; and a connection member which is arranged at a certain position of the pair of the panel members and is integrally formed with the sealing portion by heat-joining when the edge portion of the panel members are connected, and is formed in a certain shape, wherein said connection member is positioned inside between the pair of the panel members and one end of said connection member extends from between the panel member to outside the edges of the panel members.

2. An inner cloth for a glove of claim 1, wherein said certain position represents an end of each finger of the panel member.

3. An inner cloth for a glove of claim 1, wherein said connection member is rectangular.

4. An inner cloth for a glove of claim 1, wherein said inner cloth is formed of a synthetic resin, a membrane formed by providing a certain function to the synthetic resin or a cotton fabric.

5. A glove, comprising:

a lining material which directly contacts with a skin of hands;

an outer skin which is exposed to an external environment; and an inner cloth which is inserted between the lining material and the outer skin and is connected with the lining material and the outer skin, respectively, wherein the inner cloth includes a pair of hand-shaped panel members which each include a certain size or area and an edge portion connected at a certain width;

a sealing portion forming at the position which the edge portion of the panel members is joined by heat; and a connection member which is arranged at a certain position of the pair of the panel members and is integrally formed with the sealing portion by heat-joining when the edge portion of the panel members are connected and is formed in a certain shape, wherein said connection member is positioned inside between the pair of the panel members and one end of said connection member extends from between the panel member to outside the edges of the panel members.

6. The glove of claim 5, wherein said position is an end of each finger.

7. The glove of claim 5, wherein said connection member is rectangular.

8. The glove of claim 5, wherein said connection member, lining material and outer skin are connected by a sewing method.

9. The glove of claim 5, wherein said inner cloth is formed of a synthetic resin or a membrane which provides a certain function to the synthetic resin or a cotton fabric.

10. The glove of claim 5 wherein the other end of the connection member is connected to the lining material.

* * * * *